United States Patent [19]

Redhead et al.

[11] Patent Number: 4,595,421

[45] Date of Patent: Jun. 17, 1986

[54] METHOD FOR CLEANING ELECTRODES

[76] Inventors: Harry T. Redhead, P.O. Box 892, Chase B.C., Canada; Robert D. H. Willans, 1704 Topping St., Trail B.C., Canada, V1R 4G3

[21] Appl. No.: 660,490

[22] Filed: Oct. 11, 1984

Related U.S. Application Data

[63] Continuation-in-part of Ser. No. 387,261, Jun. 9, 1982, abandoned.

[30] Foreign Application Priority Data

Jun. 30, 1981 [CA] Canada ..... 380876

[51] Int. Cl.[4] ..... B08B 1/04

[52] U.S. Cl. ..... 134/6

[58] Field of Search ..... 134/6, 9; 15/21 C, 21 D, 15/77, 159 A, 160, 166

[56] References Cited

U.S. PATENT DOCUMENTS

| | | | |
|---|---|---|---|
| 2,220,982 | 11/1940 | Toney | 15/77 |
| 3,256,545 | 6/1966 | Lewis et al. | 15/159 A |
| 3,327,339 | 6/1967 | Lemelson | 15/159 A X |
| 3,501,795 | 3/1970 | Jasberg | 15/77 |

FOREIGN PATENT DOCUMENTS 68855 1/1983 European Pat. Off. .

*Primary Examiner*—Richard V. Fisher
*Assistant Examiner*—Sharon T. Cohen
*Attorney, Agent, or Firm*—Wenderoth, Lind & Ponack

[57] ABSTRACT

A dry method and apparatus for the removal of at least a portion of a removable layer of adhering impurity substances from at least one surface of an essentially electrode used in the electrolytic deposition of metals, which method comprises contacting the electrode surface with at least one cleaning means consisting of a rotating member which has attached thereto a plurality of radially projecting flexible fingers having a length to diameter ratio of about 3.56:1 and wherein the axis of rotation of the member is substantially parallel to the surface of the electrode. The rotating member may be cylindrical member having fingers attached thereto, or may be a shaft having a number of arms radially attached, the arms having attached thereto the fingers which contact the electrode. The method and apparatus of this invention afford better control of the amount of material removed, minimize electrode surface damage, and eliminate the need to process water containing removed solids.

25 Claims, 7 Drawing Figures

METHOD FOR CLEANING ELECTRODES

This is a continuation-in-part of Ser. No. 387,261, filed June 9, 1982, now abandoned.

This invention relates to a method and an apparatus for cleaning relatively loosely adhering impurity layers from electrodes used in the electrowinning and electrorefining processes of metals.

In many commercially used electrolytic processes for the recovery or refining of metals, in addition to achieving the desired metallic deposits, generally on a plurality of cathodic surfaces, deposits or coatings are also obtained, generally on anodic surfaces. These deposits or coatings can be either of a metallic or non-metallic nature. Non-metallic deposits or coatings often affect the efficiency of the electrolytic process and, therefore, have to be removed periodically from the electrode surface. The metallic coatings or deposits frequently contain commercially recoverable amounts of valuable metals and must be removed to enable the subsequent recovery of metal values.

Two forms of coating or deposit generally are encountered, of which examples can be taken from zinc and lead recovery processes. In the electrowinning of zinc, the cell electrolyte contains a small amount of manganese sulphate. As a consequence of electrolytic oxidation, a layer of manganese dioxide slowly builds up on the lead sheet anodes used in the cell. If this layer is allowed to get too thick, it loses adherence to the anode surface, forms a "bubble" thereon, and, eventually, simply falls off. This leaves an exposed electrode surface area with either a much thinner manganese dioxide layer, or no layer at all. These exposed areas exhibit a markedly reduced resistivity and thus cause localized high current densities, which in turn cause problems in the cell such as over-heating, electrode warping, or even localized electrode melting. To avoid these problems, it is necessary periodically to remove the electrode from the cell, and remove from the electrode surface at least a portion of the manganese dioxide layer from the electrode before the layer becomes too thick. In the electrolytic refining of lead another situation arises. In this process lead is dissolved from an impure lead anodic surface and purified lead is deposited onto a cathodic surface. The dissolution leaves behind a layer of metallic impurities adhering to the anodic lead surface, known as lead slimes. Regardless of whether the conventional Betts Process (slimes layer on both faces of the anodes), or the newer bipolar process (slimes layer only on the anodic face of the electrode) is being used, as the process goes on the slimes layer gets thicker due to dissolution of the lead. In the normal practise, electrodes are removed from the cell at the end of a deposition cycle for the removal of slimes and the recovery of the deposited purified lead.

Thus it is apparent that, regardless of their precise nature, formation of these deposits is inherent in the electrodeposition processes and must be controlled. Control is effected by withdrawing electrodes either periodically during the deposition cycle, or at the conclusion of a deposition cycle, and cleaning them. Where monopolar electrodes are involved, both surfaces will require to be cleaned, while where bipolar electrodes are used, the cleaning of only one side of the electrode is required.

The timing of the cleaning may vary according to the electrodeposition process. Thus, the cleaning of anodes in the electrowinning process of zinc is usually carried out periodically at 4 to 6 weeks intervals, while slimes removal from anodic surfaces of electrodes used in lead refining is generally done at the conclusion of the refining cycle.

Various methods have been proposed for the cleaning operation.

All of the used and proposed methods have a common first step, which is to clean from the electrode as much of the highly corrosive - generally strongly acidic-cell electrolyte, to provide an essentially dry electrode. This step generally is not wholly effective and always leaves some electrolytic in the non-metallic layers on the anodic surfaces. Traditionally removal of these deposits has been effected by hand scraping procedures. Hand scraping is slow, laborious, inefficient and potentially hazardous due to the small amounts of electrolyte always present in the deposits, and surface damage to the electrodes often occurs. Surface scratches and gouges cause well known problems in cell operation.

A number of mechanical techniques for the removal of layers of deposits or coatings from electrodes which include the use of high pressure water sprays, or the use of powered rotary brushes have been described. In some instances these two techniques have also been combined.

In the known machines for cleaning anodes, essentially two mechanical elements are present. Common to all of these machines, and indeed to the apparatus embodying this invention, is a mechanism designed to move the electrode to be cleaned - from which cell electrolyte has already been substantially removed - through the second mechanical element, which is the cleaning device proper.

Before considering the described cleaning devices, it is appropriate first to consider the problem that these devices face, for it is not as simple as it would appear to be. These problems arise from the differing properties of the basis electrode, and of the adhering coatings. Generally speaking, the basis electrode is a relatively soft and easily damaged metal, often in the form of a relatively thin sheet: for example the thin lead anodes used in zinc electrowinning. In sharp contrast, the coatings which it is desired to remove often are both relatively hard substances, and commonly tightly adhere to the underlying metal electrode surface: for example the manganese dioxide layer encountered in zinc electrowinning. It is also often highly desirable that not all, only most, of the adhering coating be removed: it is not always desirable to produce a clean base metal surface.

These differing properties, plus the fact that it is highly undesirable that the underlying metal surface be damaged, pose a considerably difficult problem. For if a brush is used with bristle elements which are hard enough to dislodge the coating, for example the metal wire brushes that have been recommended, then it is effectively impossible to avoid removing all of the deposit. Further, the wire bristle elements are also so hard that they will scratch the soft metal surface: the decorative finish often referred to as brushed metal is not a desirable electrode surface finish. Alternatively if a softer brush bristle is used, for example, a polypropylene one, then it is found that only a minor proportion of the coating is removed the main effect being to give the coating a polished surface finish.

Brushes also suffer from further problems again caused by the properties of the coating being removed.

It is noted above that the electrodes are generally freed from cell electrolyte before cleaning. This can never be achieved completely, mainly because the deposits tend to be somewhat porous in nature: consequently they always contain a small proportion of highly corrosive cell electrolyte, which generally is highly acidic. Consequently it is necessary that any bristles used shall have a reasonable resistance to this remaining highly acid residue: many plastics and metals do not have adequate resistance to acid - for example the nylon and mild steel often used in brushes - and thus are unsuitable. A further consequence also arises from this residual amount of cell electrolyte. Due to its presence, the material removed from the electrode surface is not quite dry and tends to adhere to and clog the brushes. This is a major problem with electrorefining electrodes, for example in removing lead slimes.

In order to overcome these deficiencies encountered with brushes containing relatively long thin bristles, it has been proposed to remove the deposits by the use of water sprays. Clearly these sprays have the advantage of not marring the electrode surface. But they do have other quite significant disadvantages. The first is that quite higher pressure water has to be used: pressures of the order of 4,500 to 6,000 psi have been advocated. The fabrication of pumping and piping systems capable of withstanding these sorts of pressures is far from simple. The operation of pumps at this sort of pressure is relatively expensive. And furthermore water jets at this sort of pressure if used injudiciously are capable literally of bending or warping - and thus rendering useless - the relatively soft metal electrodes in use. The second is that the solids removed from the electrodes either contain noxious elements which simply cannot be discharged to waste in the water, or they contain elements (such as the silver and gold recovered from copper slimes) of considerable commercial value, or even contain both noxious and valuable metals. It is therefore a necessity that this water used to remove the solids be treated to render it dischargeable to local waste systems. This is expensive, as a relatively large volume of water containing a relatively small amount of solids has to be treated: the water requirement to clean a single anode can be as high as 500 liters. Furthermore, even though water recycling can be practised, it is necessary to clarify it of suspended solids as otherwise pump and water spray jet problems result.

There is a further unexplained disadvantage with water sprays - it has been found in practice that in order to achieve a given degree of cleaning, as an electrode gets "older" more water pressure is needed. Thus at an early stage in its life, at say, its first cleaning, it may be found that 1500 psi is adequate. But later on, at, say, a tenth cleaning, it is found that a far higher pressure is needed.

A third alternative proposed and practiced in the art is to use a combination of high pressure water sprays with a rotary brush. Ideally, the brush dislodges the solids enough for the water spray to be able to remove them, or vice versa. Typical machines of this sort are described at length by Jasberg in U.S. Pat. No. 3,501,795 and by Toney in U.S. Pat. No. 2,220,982. Thus Toney describes "an improved apparatus for cleaning anodes to remove slime therefrom". It is clear from this patent that Toney's main contribution is actually an improved anode handling machine. In terms of actually cleaning an anode, Toney recommends the use of a conventional rotary brush, in combination with water sprays. Nowhere does Toney give any detailed consideration to the sort of brush bristles to be used, to the water pressures likely to be needed, not even to disposing of the contaminated water. Indeed Toney's only advice if a "particularly adherent slime is to be removed" is to pass the electrode through the brushes and sprays a second time. Similarly Jasberg describes an apparatus for "removing manganese deposits and other matter from anodic assemblies". Thus Jasber is explicitly considering the combination of a hard, tightly adherent deposit on a soft metal substrate, since, as Jasberg notes, these manganese oxide deposits are generally encountered on the lead anodes used in zinc electrowinning. However Jasberg again advocates the use of both water jets and brushes together. Jasberg advocates the use of metal or fiber brush bristles, coupled with the use of water jets provided "with high pressure water at approximately 4800 to 6000 p.s.i." Jasberg further states that "by proper control of the water pressure, nearly instant adjustment of the degree of cleaning of the anode surface is obtainable". This may be so, but it is only obtainable first by accepting the capital installation and operation costs of a very high pressure water system and second by accepting the capital installation and operation costs of a water purification system.

Nowhere does the prior art suggest that a device other than a conventional rotary brush containing thousands of relatively long thin bristles alone or assisted by high pressure water can be of use adequately to clean electrolysis process electrodes. The provision of such a device which would both remove the adherent coatings in the substantially dry state and be cheap to operate would clearly represent an advance in the electrode cleaning art.

We have now found that these relatively loosely adhering deposits or layers can be efficiently removed by the use of a power driven rotating member, to which is attached a plurality of radially projecting flexible fingers. Apparatus of a similar type has been proposed for the removal of feathers from poultry in U.S. Pat. Nos. 2,512,843 (issued June 27, 1950 to E. J. Albright) and 2,235,619 (issued Mar. 18, 1941 to E. E. McMahan et al).

These fingers, as is discussed in more detail below, are quite different in size, shape and appearance to conventional brush bristles. As used in a conventional brush, the bristles are generally long, thin, and more or less flexible. A bristle thickness of perhaps 1 mm is the thickest generally used, with a length of up to 10 cm or more. Thus in a brush as commonly used in cleaning anodes the length to diameter ratio for a bristle is usually higher than 10:1, and commonly of the order of 100:1. In fact, conventional brush bristles are used. Additionally, a brush contains a large number of such bristles, the total number of bristles being in the thousands, if not higher.

The fingers used in this invention, in sharp contrast to a bristle, are short, stubby, and relatively thick. The finger diameter can be more than 20 mm, while the effective length of the finger (i.e. ignoring the basal anchoring portion) can be in the range of from 80 mm to 100 mm. Thus these fingers typically have a length to diameter ratio in the range of from about 3:1 to about 5.1.

It is not understood why the fingers used in this invention are so effective. In the preferred embodiments, discussed below, it will be seen that fingers are used which are those commercially available for use in poultry plucking machines as described by George R. Hunt in U.S. Pat. No. 2,300,157 (issued Oct. 27th, 1942) and in Canadian Pat. No. 421,064 (issued June 27th, 1944). Other similar poultry picking machines are described by E. E. McMahan et al in U.S. Pat. No. 2,235,619 (issued Mar. 18th, 1941) and by K. Tomlinson in U.S. Pat. No. 2,512,843 (issued June 27th, 1950). In both the McMahan et al and Tomlinson disclosures rubber fingers of the same type as those described by Hunt are used. Clearly the problem presented by the removal of feathers from recently killed poultry presents a quite different problem to removing deposits from electrodes. It is therefore quite surprising that these poultry plucker fingers are so effective in removing electrode deposits, especially the manganese oxide deposits encountered on the lead cathodes used in zinc electrowinning.

Thus in a first embodiment, this invention provides a dry method for the removal of at least a portion of a removable layer of adhering impurity substances from at least one surface of an electrode used in the electrolytic deposition of metals which method comprises contacting the electrode surface with at least one cleaning means consisting of a rotating member which has attached thereto a plurality of radially projecting flexible fingers having a length to diameter ratio of about 3.56:1, and wherein the axis of rotation of the member is substantially parallel to the surface of the electrode.

In a second embodiment, this invention provides an apparatus for removing at least a portion of a removable layer of impurity substances adhering to an electrode surface which apparatus comprises in combination at least one rotatable member having attached thereto a plurality of radially projecting flexible fingers; means to rotate the rotatable member about its axis at a suitable speed; means to maintain the rotatable member at a desired substantially constant distance from the electrode surface; and means to traverse the electrode surface relative to the rotatable member thereby to remove adhering substances from the electrode surface.

Preferably, the radially extending fingers are made of an elastomeric material such as, for example, rubber or a rubber-like material of either natural or synthetic origin.

This invention does not extend to and is not concerned with a method or apparatus for the removal from an electrode of a layer of metal deposited thereon, as a consequence of the electrolytic process being operated. Such massive deposits of the metal being recovered or refined require other means for their removal from electrodes.

The invention will now be described in some detail and by way of reference to the attached drawings in which.

Figure 6:
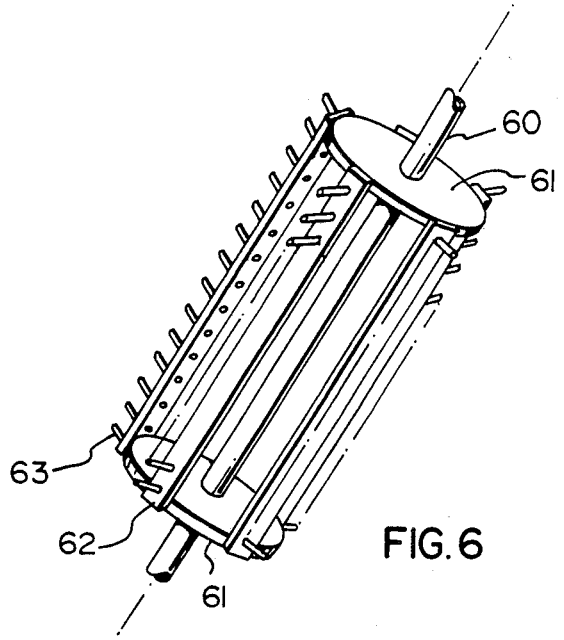
Figure 7B:
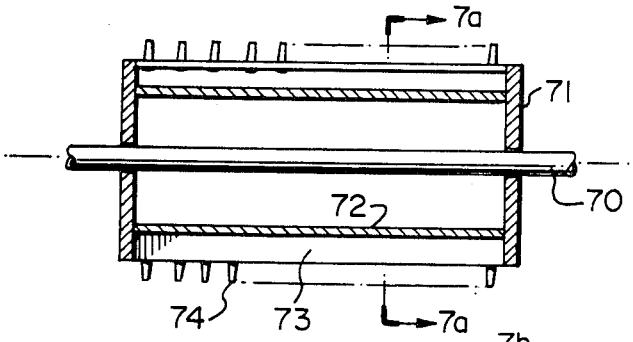
Figure 7A:
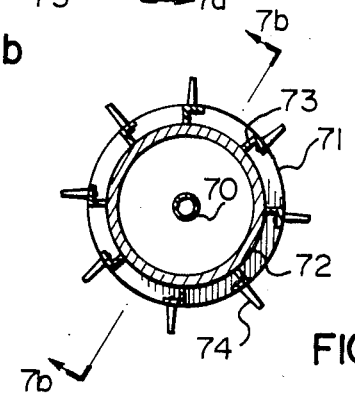

FIGS. 6, *7a* and *7b* show two rotatable members used in the Examples.

Figure 1:
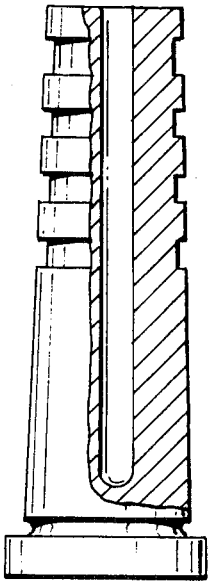
FIG. 1 shows a commercially available poultry plucker finger.

In the apparatus of this invention the elastomeric fingers used are of generally cylindrical configuration (as is shown, for example, schematically in FIG. 2) and have a length to diameter ratio of from about 3:1 to about 5:1. An important feature of the finger is its flexibility. This can be controlled in two separate ways separately: by choice of the elastomer, and by choice of finger design. As rubbers, either natural, synthetic, or mixed, are the preferred materials, these two aspects are easiest discussed in this context. From the elastomer standpoint the flexibility can be controlled by the selection of the vulcanizing conditions. From the design standpoint, the flexibility can be controlled by changing overall dimensions, or even by providing an axial hole. Both of these are shown by the commercially available poultry plucker finger, which is shown in FIG. 1. As can be seen from the figure, the finger has a length to diameter ratio of approximately 3.4:1, and also has an axial hole of about one third the diameter of the distal end extending substantially to the base of the finger. These commercial fingers are also provided with the four shallow grooves shown. Whilst these may be of importance in poultry plucking - similar configurations are shown in all three of the poultry plucker patents mentioned above - these grooves are probably of little importance in anode cleaning except insofar as their presence affects the flexibility of the finger.

Figure 2:
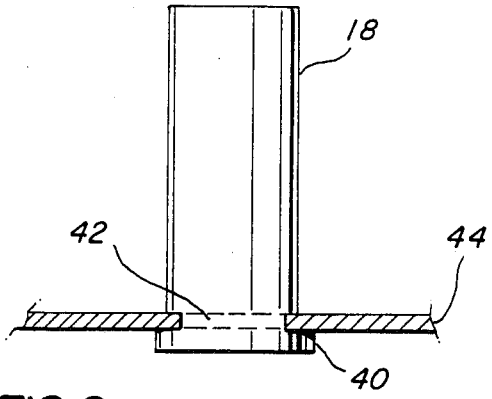
FIG. 2 shows one method of mounting such a finger.

When an elastomer finger of this type is used it can be conveniently mounted into the rotatable member by providing in the finger a groove near its base, as is shown in FIG. 2. The annular groove 42 cooperates with the head 40 to provide a good fit in the hole 44. Preferably the groove 42 is sized to be a little larger than the hole thus leaving the base portion of the finger slightly low pressed. Preferably the head 40 is also somewhat larger than the finger body portion 18. The finger is mounted quite simply by inserting it into the hole and forcing it through until the groove 42 seats into the hole. A plurality of mounted fingers are used in the rotatable member of this invention.

Figure 3:
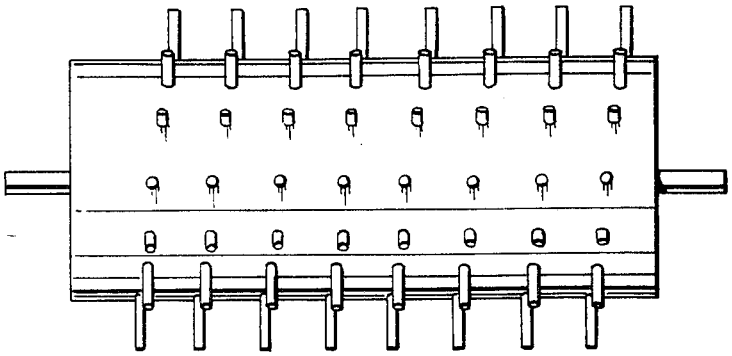
FIG. 3 shows one form of rotatable member.

Our arrangement for the rotatable member is shown in FIG. 3. This is a simple drum, with a plurality of holes through which the fingers are inserted, on a rotatable shaft. As can be seen from the figure, each succeeding row of fingers is off set laterally, so that as the drum rotates the entire surface of the electrode is exposed to the fingers.

In some respects, a cylinder or drum as shown in FIG. 3 has certain disadvantages. Commercial electrodes commonly have dimensions in excess of one meter in each direction. This means that the drum has to be some what over a meter in length, to allow for any imprecision in aligning the electrode with the drum for cleaning. It then becomes difficult to mount the fingers in the central portion of the drum, as the holes cannot easily be reached due to their distance from the end of the drum. Further, the internal supports by which the drum is mounted on its shaft also interfere with access to the finger mounting holes.

Figure 4:
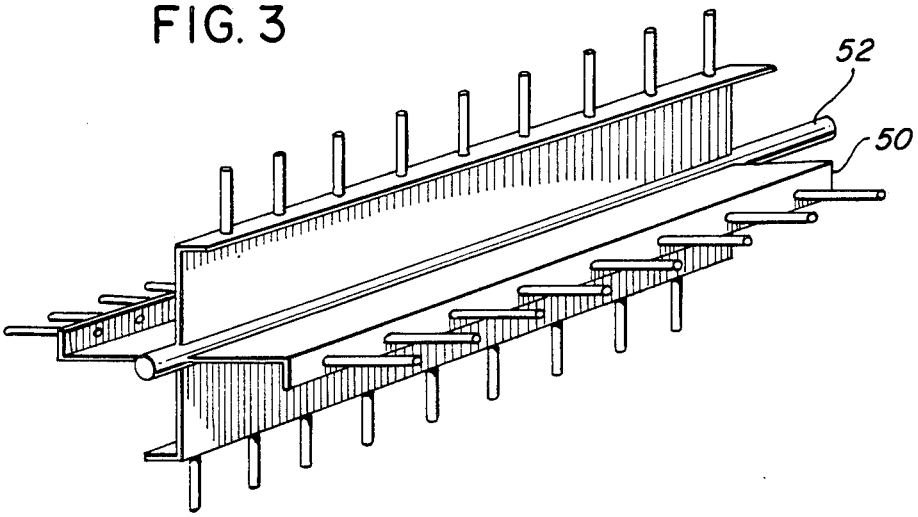
FIG. 4 shows an alternative preferred form of rotatable member.

To overcome this, the alternative form of rotatable member shown in FIG. 4 has been developed. Even though this device only contains four rows of fingers - which again are off-set to give total surface coverage - it has been found to be extremely effective in operation. It is also both simple to fabricate and to maintain since there is ready access to all of the finger mounting holes. In this form of preferred rotatable member, all of the fingers are mounted through a radial arm 50 mounted on the shaft 52. Clearly either less than four, or more than four, rows of fingers could be used. However four rows provides both simple fabrication and simple balancing of the whole assembly and thus is a preferred construction.

Figure 5:
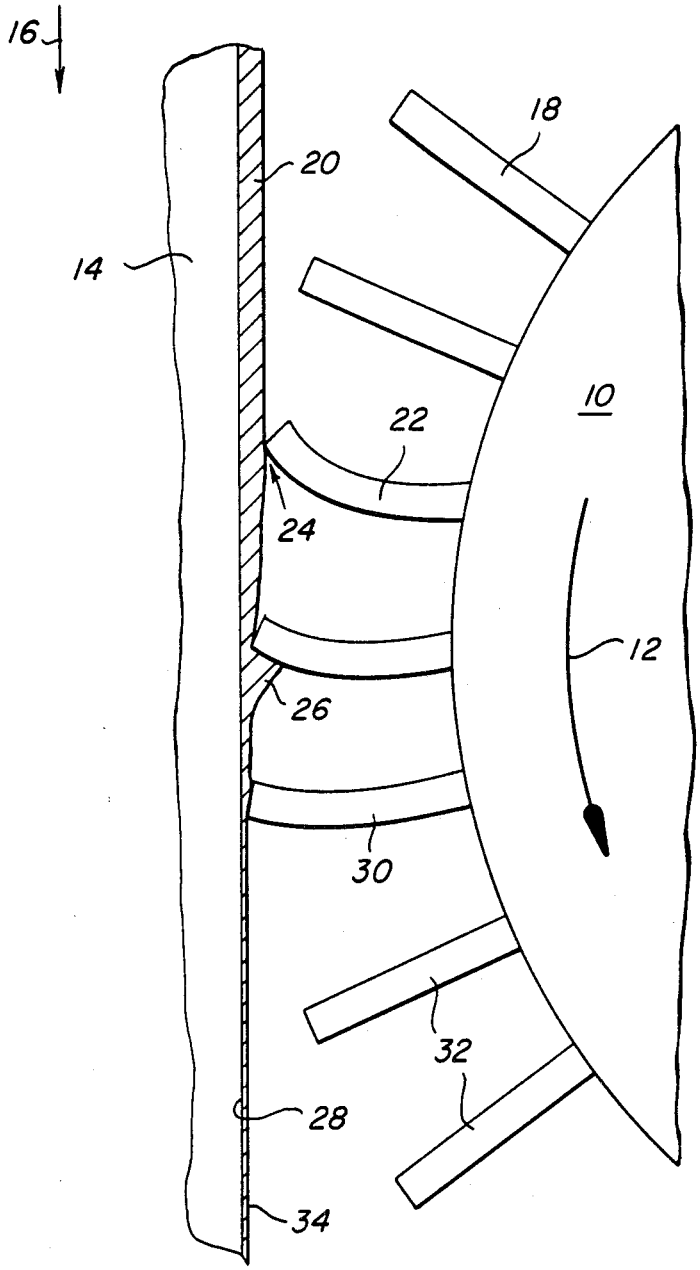
FIG. 5 shows schematically the manner of operation of the fingers.

The action of the flexible fingers on the surface of an electrode during the cleaning operation is shown schematically in FIG. 5. For clarity, the details of the finger design shown in FIG. 1 have been omitted, as also has the manner of mounting the fingers.

In FIG. 5 a portion of a rotatable member is shown at 10, in this instance a cylinder or drum. The drum rotates in the direction of the arrow 12. A portion of the electrode is shown at 14, which is moving relative to the drum axis, in the same direction as the fingers, as is indicated by the arrow 16. It is to be especially noted that the electrode when being cleaned is essentially dry, that no water sprays are used in conjunction with the fingers. Attached to the drum 10 are a plurality of radially projecting flexible and resilient fingers 18.

The action of the removable fingers 18 on the layer 20 can best be seen by ignoring the relative movement of the electrode and the cylindrical member. Initially, as shown, fingers 18 are effectively radially upstanding from the cylinder surface. As a finger impacts onto the removable layer 20, the finger bends and flexes as shown at 22 and digs into the layer 20 as shown at 24, causing a build-up of impurity substances in front of the fingers as shown at 26. As the finger moves further, this build-up breaks away, leaving a cleaned surface 28. At this point the finger generally will still be somewhat bent as shown at 30. As soon as the finger loses contact with the layer it will again assume a radial configuration as shown at 32. If movement is now taken into account, it can be seen that, as the electrode moves, fresh areas of the layer 20 are exposed to the fingers 18 and thus the whole of the electrode is progressively cleaned. It is understood that the same cleaning is obtained when the rotatable member is reversed.

Thus it can be seen that suitable positioning of the fingers is necessary to clean an entire electrode surface. If the fingers are mounted on a cylinder or drum, as contemplated in FIG. 5, this positioning can be easily achieved by arranging the fingers in a helical or staggered fashion, as is shown in FIG. 3.

It is understood that the cleaned electrode surface may comprise a thin residual layer of removable impurity substances as shown at 34. For example, when cleaning lead alloy electrodes from a zinc electrowinning process, it is desirable to leave a uniform thin layer of manganese dioxide on the electrode. When cleaning slimes from electrodes from electrolytic lead refining, it is desirable, however, to remove as much of the slimes as possible.

It is noted above that the electrodes are cleaned by the fingers in an essentially dry condition. It is also noted above that, however, the coatings being removed are nearly always not quite dry; for example lead slimes are rarely dry. The action of the fingers devalues this coating effectively, and nearly all of it can be recovered as a solid by providing a suitable enclosure about the cleaning apparatus. However a small minor proportion of the removed material sometimes is left adhering to the cleaned electrode surface. This is essentially small particles of material which have been removed by the fingers, and then found their way back onto the electrode surface. In the case of a bipolar electrode where only one surface is being cleaned it can sometimes happen that some material also gets onto the surface not exposed to the action of the fingers. There are several ways in which these random particles can be removed. As they are only very loosely attached to the electrode, we have found that the easiest way to remove them is by using a low pressure low volume water spray, for example from a simple hand-held hose.

When operating the method of this invention, there are a number of parameters to which consideration should be given.

The number of rotatable members is essentially determined by the number of surfaces to be cleaned. If electrodes are being cleaned on one side only, for example, a bipolar electrode, then a single rotatable member will suffice. For cleaning both sides, two rotatable members are required. It is comparatively simple to assemble a plurality of rotatable members in a suitable orientation to accept a plurality of electrodes simultaneously or in sequence. A plurality of rotatable members may also be used on either or both sides of the electrodes, such that the plurality of members provide coverage for all of the surface of the electrode desired to be cleaned.

The speed of rotation of the rotatable member carrying the fingers is related to a number of other factors. These are the flexibility of the fingers on the rotatable member, the gap between the rotatable member and the electrode, the amount of deposit to be removed and the quality of that deposit. A set of values for these variables which will effect the desired amount of layer removal can be determined by simple experiment. If the fingers are too flexible, insufficient or no removal will result. If they are too stiff, they will be subject to excessive wear and, also, damage to the electrode surface may occur. Consequently, for fingers made from a given material there is an "ideal" gap, which can be measured from the axis of the rotatable member to the electrode surface and which gives the deflection of the fingers necessary to obtain the required degree of removal. The speed of rotation has some effect on how hard the fingers impact on the layer being removed and thus affects both the amount removed and the rate of wear of the finger tips which impact onto the layer.

Usually, means are provided to maintain the rotatable member at a desired, substantially constant distance from the electrode surface. Control of the gap between the rotatable member and the electrode can be effected in several ways using conventional means. For a given finger length, the gap should be kept approximately constant but, since the fingers bend somewhat on impacting the electrode surface, a degree of latitude of adjustment exists. The commercially used electrodes sometimes have a taper, for example, of some 5–8 mm over a distance of 1 meter, but adjustment to accommodate this has not been found to be necessary. A further relevant factor is that the portion of the layer nearest to the basis electrode metal often is either harder, or more tightly adhering, than the most distant portions of the layer. Such is for instance the case with the manganese dioxide layer on lead alloy anodes used in the electrowinning of zinc. This change in layer quality itself exerts a not inconsiderable controlling effect on the amount of the layer that is removed.

Thus, although sophisticated automatic adjustment techniques could be used, in practice this has been found not to be necessary. All that needs to be done is first to set the gap manually to achieve the desired level of removal, and second to readjust the gap periodically thereafter to accommodate wear of the fingers. Both of these adjustments can be carried out manually or by means of well known mechanical devices. The settings used are based upon inspection of the cleaned electrode surface by the operator.

The radially extending flexible fingers may be attached directly to the rotatable member as has been described above in some detail. Alternatively, the flexible fingers may be attached to or fitted partly over metal shanks protruding a short distance from the surface of the member such that each flexible finger forms a flexible tip extending from the shank. The metal shanks themselves can also be made of flexible material, for example springs. The important criterion is that the finger, as a whole, has the desired flexibility characteristics. It is also to be noted that if metal shanks are used, they should preferably not be so long that when the flexible tip wears away the metal shank could protrude and impact the electrode.

In practice it has been found that the type of finger shown in FIG. 1 is both practical in use and satisfactory from the cleaning point of view. These fingers, as commercially available, are prepared from a mixture of natural and synthetic rubbers. It appears that adequate layer removing capability coupled with an adequate finger life are obtained when the elastomer has a Shore A hardness of from about 40 to about 60.

The orientation of the rotatable member relative to the electrode is largely a matter of choice. Electrodes are generally of different sizes but substantially square or oblong in shape. The rotatable member will generally be aligned substantially parallel to a face of the electrode. The parallel alignment can be such that the axis of rotation of the rotatable member is positioned either horizontally or vertically, as will be described below.

In order to effect removal of the deposit from the electrode surface, the rotatable member and the electrode must move relative to each other, or even both could be moved. We prefer to traverse the electrode past the rotating rotatable member, for example by using an electrode handling system similar to those described in the Toney and Jasberg patents mentioned earlier.

Where two rotatable members are being used to clean both surfaces of the electrode simultaneously, then the forces exerted on the electrode through the fingers are mutually balanced. Where only one side is being cleaned, the traversing mechanism needs to be such that the electrode to rotatable member gap is maintained at the desired value. For example, the traversing mechanism may include one or more stationary, freely rotating or driven rollers or discs which are positioned on the opposite side of the electrode to the side being cleaned. Such rollers or discs provide the necessary means to maintain the gap at the desired value and balance the exerted forces. The axes of rotation of such rollers or discs are preferably positioned parallel to the axis of the rotatable member.

Some consideration of the relative direction of motion of the fingers and the electrode surface is also appropriate. The electrode can move past the rotatable member in such a way that the fingers are moving either in the same direction as the electrode surface, or in the opposite direction as the electrode surface, where the axis of the rotatable member is substantially parallel to a face of the electrode. Although both modes are possible, we prefer to have the fingers travelling in a direction opposite to that of the electrode surface, in order to avoid contamination of the cleaned surface with removed material.

Depending on the size of electrodes and on whether one or both sides of the electrodes is to be cleaned, one or more rotatable members may be used which are positioned either on one side or on both sides of the electrode. The electrodes can be cleaned by lowering each electrode past the rotatable member(s) to effect cleaning and then raising the electrode from contact with the member(s). In this case, the axis of the rotatable member is preferably positioned horizontally. Alternatively, the axis can be positioned substantially vertically and each electrode is moved past the rotatable member in a vertical position in a horizontal direction. This eliminates the lowering and raising of electrodes. This alternative arrangement is particularly suitable for cleaning a large number of electrodes and cleaning large size electrodes, and cleaning in a continuous fashion.

The apparatus and especially the rotatable members are shrouded with a suitable cover to contain impurity substances when they are being removed from the electrodes.

The invention will now be illustrated by means of the following non-limitative examples.

EXAMPLE 1

Using an apparatus having a pair of cylindrical members, as shown in FIG. 3, lead alloy anodes from zinc electrowinning cells were processed to remove a major proportion of the manganese dioxide layer from the anodes. This layer had slowly built up over a period of approximately six weeks of use in the cell. Before placement in the cells, the anodes were approximately 1 meter square, tapering in thickness from 16 mm at the top to 10 mm at the bottom. Each of the cylinders was a steel drum of 762 mm diameter rotated at approximately 500 rpm by an electric motor. On each drum were mounted in staggered rows, 510 rubber fingers each 89 mm long and 25 mm in diameter. The cylinder axes were placed 770 mm apart, thus leaving an 8 mm space between the ends of the fingers. The cylinders were aligned horizontally and each of the electrodes was lowered and subsequently raised vertically through the space. Upon withdrawal, a uniform layer of manganese dioxide approximately 2 mm thick was left on both surfaces of the electrodes.

EXAMPLE 2

Using a similar apparatus as in Example 1, but with cylinders of 203 mm diameter, the same fingers of 89 mm length, and a gap adjusted to 10 mm, electrodes from a lead refining cell using the Betts Process were cleaned. The 32 mm thick electrodes had a 9.5 mm thick slimes layer on each side. Each electrode was passed vertically suspended in a horizontal direction through the gap between the vertical cylindrical members, which rotated at 718 rpm. The slimes layers were effectively and substantially removed from the electrodes.

EXAMPLE 3

Using an apparatus according to the invention, electrodes from lead refining cells using the bipolar process were cleaned. In this case only one side of the electrodes required cleaning to remove the slimes remaining on the anodic face. The apparatus comprised one cylindrical member similar to one of the members used in the apparatus of Example 2. The cylinder axis was positioned vertically and parallel to the electrode face to be cleaned. A counteracting force was provided on the other side of the electrode by positioning 4 freely rotating disc rollers opposite the cylindrical member such that an 8 mm gap existed between the disc rollers and the fingers on the member. The length of the cylindrical member was sufficient to clean the slimes from the anodic face of the electrodes. The 25 mm thick electrodes had a 9.5 mm thick slimes layer. Each electrode was passed vertically suspended in a horizontal direction through the gap. The cylindrical member was rotated at 700 rpm. The slimes layer was effectively and substantially removed from the electrodes.

After the electrode had been cleaned, to ensure that the lead deposit on the other face of the electrode had not become contaminated with any removed lead slimes, the electrode was washed down with a low pressure low volume water spray.

EXAMPLE 4

A composition was also made between two different types of rubber fingers made from different rubber compositions. The change made was to vary the ratio of natural rubber to synthetic rubber in the elastomer used, thus resulting in a different hardness for the fingers. The fingers of Type A had a higher ratio of natural rubber to synthetic rubber than the fingers of Type B, and thus were somewhat softer (as is reflected in the Shore A hardness) and more flexible than Type B.

Both types of fingers were tested for an extended period of time in the cleaning of lead anodes, from a zinc electrowinning process, to remove the adhering manganese dioxide layer.

| Finger Type | Hardness Shore A | Specific Gravity | Anodes Cleaned | Weight Loss, g. | Volume Loss, $cm^3$ |
|---|---|---|---|---|---|
| A | 45 | 1.04 | 14,000 | 0.3441 | 0.331 |
| B | 52–57 | 1.06 | 8,000 | 1.0748 | 1.014 |

The weight and volume loss are both averaged figures for the group of fingers used.

These figures clearly show that these fingers provide a relatively simple and inexpensive cleaning method in which a high finger life can be expected. These figures also suggest that the softer Type A fingers are better than the Type B fingers.

EXAMPLE 5

In this example, anodic electrodes from conventional lead refining cells (of the monopolar type) operated according to the Betts Process were cleaned. The apparatus in addition to the usual equipment to move the electrodes, included two cleaning members which were as shown in FIG. 6. Each member consists essentially of a shaft 60 to which are attached flanges, 61, across which are attached flat bar plates, 62, into which the rubber fingers 63 are mounted through suitable holes. As can be seen readily this form of rotatable member is simple to construct, and provides free access to the holes for mounting (or replacing) the fingers.

As used in this Example the flanges 61 had a diameter of 20 cm, and had attached between them five flat bar plates 50 mm wide, 3 mm thick, and approximately 120 cm long. Sixteen rubber fingers were mounted into each plate. The rubber fingers tapered from 27 mm down to 20 mm diameter and were 89 mm long (i.e. a ratio of length to diameter of about 3.8:1 taking an average diameter of 23.5 mm). The two rotatable members were mounted parallel to each other, with their axes at 30° off vertical. The electrodes were vertically suspended and were passed horizontally between the members, which were rotated at 120 rpm. Electrolysis slimes were effectively and substantially completely removed from the electrodes.

EXAMPLE 6

In this example bipolar electrodes from a lead refining cell were cleaned of the slimes on their anodic sides. The rotating member used is shown in FIGS. *7a* and *7b*. It consists of a shaft 70 onto which a made-up drum is mounted consisting of the flanges 71 and drum 72 therebetween. Onto the drum and between the flanges are welded angle pieces 73, with suitably placed holes to receive the fingers 74. Again this unit is of simple and rugged construction, and provides clear access to the fingers for mounting and replacing them.

As used in this Example the flanges were of 35 cm diameter, the drum 15 cm diameter, and the overall length was 161 cm. Eight 10 cm×10 cm 90° angle pieces were used, into which the same fingers as used in the previous examples were inserted with a 5 cm interval between them: each angle piece thus carried 30 fingers. In this case, the electrode was kept still, and the rotating member, operating at a similar speed to Example 5, and with its axis horizontal, was moved up and down to clean the anodic electrode face. Slimes layer removal was satisfactory.

EXAMPLE 7

To provide a comparison with the preceeding Examples, some details of a dry brush technique are presented. Commercially available brushes use either nylon or polypropylene bristles. Nylon bristles are useless because plastic breaks down on extended immersion in cell electrolyte. Two brushes were tested having polypropylene bristles:

A: 30 cm brush face, 15 cm diameter brush core, bristle length approximately 38 mm, bristle diameter approximately 0.56 mm.

B: 30 cm brush face, 15 cm diameter brush core, bristle length approximately 75 mm, bristle diameter approximately 0.56 mm.

The brushes were mounted on a stand and driven at 400 rpm., and used in an attempt to clean lead anodes having manganese dioxide layers on them, similar to those cleaned efficiently dry by the fingers in Examples 1 and 4 above. The anodes were moved past the brushes with a crane, and pressed by hand against the brush. Neither brush was successful in cleaning off the manganese dioxide layer. A minimal amount of material was removed, and a polished finish provided on the unremoved manganese dioxide.

We claim:

1. A dry method for the removal of at least a portion of a removable layer of adhering impurity substances from at least one surface of an electrode used in the electrolytic deposition of metals, which method comprises contacting the electrode surface with at least one cleaning means consisting of a rotating member which has attached thereto a plurality of radially projecting flexible fingers having a length to diameter ratio of about 3.56:1 and wherein the axis of rotation of the rotating member is substantially parallel to the surface of the electrode.

2. A method according to claim 1, wherein at least one member is used to contact one side of an electrode.

3. A method according to claim 1, wherein at least two members are used, to contact both sides of an electrode.

4. A method according to claim 1, wherein the electrode is moved relative to the member, thereby to contact the member.

5. A method according to claim 4, wherein the relative direction of motion of the electrode and the rotation of the member is such that the flexible fingers when contacting the electrode surface are moving in a direction substantially opposite to the direction of the electrode surface being contacted.

6. A method according to claim 1, wherein the flexible fingers are made of rubber or a rubber-like material.

7. A method according to claim 1, wherein the flexible fingers are made of natural rubber, synthetic rubber, or of a mixture of natural and synthetic rubbers.

8. A method according to claim 1, wherein the electrode is a bipolar electrode used in an electrorefining process and the removable layer consists of metallic slimes.

9. A method according to claim 1, wherein the electrode is a monopolar electrode used in an electrorefining process and the removable layer consists of metallic slimes.

10. A method according to claim 1, wherein the electrode is a monopolar lead electrode used in an electrolytic recovery process, and the removable layer consists of deposited impurities.

11. A method according to claim 1, wherein the electrode is a bipolar lead electrode used in the electrorefining of lead and the removable layer consists of metallic slimes.

12. A method according to claim 1, wherein the electrode is a monopolar lead electrode used in the electrorefining of lead and the removable layer consists of metallic slimes.

13. A method according to claim 1, wherein the electrode is a monopolar lead electrode used in the electrolytic recovery of zinc and the removable layer is substantially manganese dioxide.

14. A method according to claim 1 including the additional step of washing the electrode with a low pressure low volume water spray after it has been contacted with the cleaning means in a substantially dry condition.

15. A method according to claim 1 wherein the rotating member rotates at a speed of from 500 to 700 revolutions per minute.

16. A method according to claim 1 wherein the amount of adhering impurity substance removed is controlled by adjusting the distance between the surface of the electrode and the axis of rotation of the rotating member.

17. A method according to claim 1 wherein the flexible fingers are made of a mixture of natural and synthetic rubber, have a length of about 85 mm, have a diameter of about 25 mm, and have an axial central hole extending to close to the base of the finger from the tip with a diameter of about 10 mm.

18. A method according to claim 1 wherein the flexible fingers are made of a mixture of natural and synthetic rubbers, which has a Shore A hardness of from about 40 to about 60.

19. A method according to claim 3 wherein the electrode is a monopolar lead electrode used in the electrolytic recovery of zinc and the removable layer is substantially manganese dioxide.

20. A method according to claim 2 wherein the electrode is a bipolar electrode used in an electrorefining process and the removable layer consists of metallic slimes.

21. A method according to claim 3 wherein the electrode is a monopolar electrode used in an electrorefining process and the removable layer consists of metallic slimes.

22. A method according to claim 3 wherein the electrode is a monopolar lead electrode used in an electrolytic recovery process, and the removable layer consists of deposited impurities.

23. A method according to claim 2 wherein the electrode is a bipolar lead electrode used in the electrorefining of lead and the removable layer consists of metallic slimes.

24. A method according to claim 3 wherein the electrode is a monopolar lead electrode used in the electrorefining of lead and the removable layer consists of metallic slimes.

25. A dry method for the removal of at least a portion of a removable layer of adhering impurity substances from at least one suface of an electrode used in the electrolytic deposition of metals, which method comprises the steps of:

(a) contacting the electrode surface with at least one cleaning means consisting of a rotating member having an axis of rotation substantially parallel to the surface of the electrode, said member having attached thereto a plurality of radially projecting flexible fingers made of an elastomeric material and having a length to diameter ratio of about 3.56:1, said fingers being arranged on said rotating member in a helical or staggered fashion whereby the entire surface of the electrode is cleaned and so that no clogging of the rotating member and fingers by removed removable layer occurs;

(b) rotating said member at a speed in the range of from about 500 to about 700 revolutions per minute;

(c) impacting said fingers on said removable layer;

(d) maintaining said member at a substantially constant distance from the electrode surface;

(e) moving the electrode relative to the at least one cleaning means thereby to clean at least one surface thereof; and (f) controlling the amount of removable layer removed by adjusting the speed of rotation, and by adjusting the distance between the electrode surface and the axis of rotation of the at least one cleaning means whereby removable layer is removed from the electrode with the required degree of removal and without damaging the surface of the electrode.

* * * * *